US007415923B2

(12) United States Patent
Starrett et al.

(10) Patent No.: US 7,415,923 B2
(45) Date of Patent: Aug. 26, 2008

(54) METHOD OF AND SYSTEM FOR SEDIMENTATION RETAINING BARRIER PACKING AND HANDLING

(75) Inventors: Kenneth Starrett, Arlington, TX (US); Rocky A. Van Gilder, Rice Lake, WI (US)

(73) Assignee: American Excelsior Company, Arlington, TX (US)

( * ) Notice: Subject to any disclaimer, the term of this patent is extended or adjusted under 35 U.S.C. 154(b) by 429 days.

(21) Appl. No.: 11/252,647

(22) Filed: Oct. 18, 2005

(65) Prior Publication Data

US 2006/0093441 A1 May 4, 2006

Related U.S. Application Data

(60) Provisional application No. 60/619,662, filed on Oct. 18, 2004.

(51) Int. Cl.
*B65B 13/20* (2006.01)

(52) U.S. Cl. ..... 100/3; 53/399; 53/429; 53/436

(58) Field of Classification Search ..... 100/1, 100/2, 3, 8; 53/399, 429, 436
See application file for complete search history.

(56) References Cited

U.S. PATENT DOCUMENTS

| | | | | |
|---|---|---|---|---|
| 4,474,846 | A | 10/1984 | Doerer et al. | |
| 4,610,568 | A | 9/1986 | Koerner | |
| 5,007,766 | A | 4/1991 | Freed et al. | |
| 5,160,215 | A | 11/1992 | Jensen | |
| 5,330,828 | A | 7/1994 | Jacobsen, Jr. et al. | |
| 5,419,659 | A | 5/1995 | Mercer | |
| 5,459,181 | A | 10/1995 | West et al. | |
| 5,484,501 | A | 1/1996 | Jacobsen, Jr. et al. | |
| 5,584,600 | A | 12/1996 | Langdon | |
| 5,595,458 | A | 1/1997 | Grabhorn | |
| 5,605,416 | A | 2/1997 | Roach | |
| 5,651,641 | A | 7/1997 | Stephens et al. | |
| 5,709,925 | A | 1/1998 | Spengler et al. | |
| 5,852,969 | A * | 12/1998 | Anthony | 100/34 |
| 5,942,029 | A | 8/1999 | Spittle | |
| 6,056,901 | A | 5/2000 | Hamatani et al. | |
| 6,109,835 | A | 8/2000 | Grabhorn | |
| 6,709,202 | B2 * | 3/2004 | Spangler et al. | 405/302.6 |
| 6,855,650 | B1 | 2/2005 | Bohannon, Jr. | |
| 6,910,835 | B2 * | 6/2005 | Spangler et al. | 405/302.6 |

* cited by examiner

*Primary Examiner*—Jimmy T Nguyen
(74) *Attorney, Agent, or Firm*—Winstead PC

(57) ABSTRACT

An erosion control log and method for packing and handling erosion control logs. In one aspect, the erosion control logs are formed, stacked, compressed and prepared for delivery while retaining maximum decompressibility.

28 Claims, 6 Drawing Sheets

METHOD OF AND SYSTEM FOR SEDIMENTATION RETAINING BARRIER PACKING AND HANDLING

RELATED APPLICATION(S)

This application claims priority to and incorporates by reference the entirety of U.S. Provisional Patent Application No. 60/619,662 filed Oct. 18, 2004.

BACKGROUND OF THE INVENTION

1. Technical Field of the Invention

The present invention relates generally to erosion control logs and, more specifically to the packing and handling thereof and, more particularly, but not by way of limitation, to a system and method for selectively stacking, configuring, compressing, securing and subsequently handling a plurality of erosion control logs adapted for delivery to field site, for the reduction of soil erosion.

2. History of Related Art

For many years, erosion control blankets and logs have achieved widespread commercial acceptance. Their use is worldwide. Erosion control blankets in general are discussed in co-pending U.S. patent application Ser. No. 09/648,906, assigned to the assignee of the present invention. As referenced therein, the blankets resemble a form of fibrous matting in which outer layers of netting or other material are commonly used to form an envelope or covering about a fibrous interior filler layer of the type commonly used to reduce soil erosion and runoff from erosion-prone areas such as highway embankments or water drainage ditches. They may be manufactured from a variety of materials.

Another erosion control device is the "erosion control log". Erosion control logs utilize fibers packaged within an elongate bag-type of structure for reducing hydraulic energy and filtering sediment-laden runoff. One such erosion control log is sold under the trademark Curlex® sediment log sold by the assignee of the present invention. The sediment log is manufactured from excelsior, also known as wood wool. The log is thus very porous, allowing water to pass through the wood wool, or excelsior matrix, progressively slowing velocity and filtering sediment as it passes through the log diameter. Sediment logs of this type are extremely flexible and contour to the terrain to maintain intimate contact with the subgrade. Additionally, they come with other benefits such as being lightweight, requiring no trenching, substantially eliminating disposal hassles, and being reusable while holding their shape. Such sediment logs are commonly used in place of straw and hay bail checks, which have been shown to be less than capable of prolonged use in heavy rains wherein the hay bail structurally degrades resulting in the hay fibers being washed downstream, possibly to clog various water flow outlets. This situation can exacerbate flooding issues. Similarly, silt fences, also commonly used, are prone to being knocked down when rain or strong winds are present, or when run over by vehicles. The time required to pick up lose hay fibers from hay bails and/or to remove worn out, or dysfunctional silt fences, which must be taken typically to land fills, imposes increased expense to contractors trying to meet the ever-growing number of federal, state and municipal regulations. These regulations are increasingly requiring erosion control around construction sites. Additionally, new regulations are placing limitations on dumping waste material in land fills and restricting the burning of waste materials.

Examples of other prior art structures include those shown in U.S. Pat. Nos. 5,595,458 and 6,109,835, both assigned to Grabhorn, Inc. These patents describe water permeable erosion control bags having flexible mesh walls and wood fiber fragments contained therein. U.S. Pat. No. 5,419,659 to Mercer describes a mesh structure having openings and can be used as a sack or a bag. The structure of U.S. Pat. No. 5,419,659 may be formed into a tubular biaxially stretched mesh structure closed at the top and bottom ends.

Other teachings are present in the above-referenced and following patents, and comments made herein are in no way intended to imply any limitations in the teachings thereof but only to specifically address certain aspects for purposes of describing the related art. The entirety of each of the references cited herein should be reviewed for a full understanding of the related art relative to the present invention.

Additional references to erosion control structures include that shown in U.S. Pat. No. 5,160,215 to Jensen which generally describes a ground surface erosion control device. U.S. Pat. Nos. 5,007,766, 5,584,600, 5,605,416 and 4,610,568 also describe erosion control barriers of various types and shapes. Some of the above-referenced patents describe sediment barriers for reducing the erosive energy of water flow-through on a water course such as a channel for increasing the deposition of sediments therein. The sediment barrier typically includes a plurality of individual strands interwoven and preferably crimped or otherwise distorted in an external configuration so as to provide, in certain instances, fiber-to-fiber cohesion which helps maintain the overall rate of the barrier. As referenced in U.S. Pat. No. 5,007,766, the sediment barrier of this particular design may be anchored in place on a surface or within a gully, so as to maintain the strands in upright relation to the water course.

Typical applications for such erosion control devices, particularly the sediment log sold by the assignee of the present invention, are for energy dissipation and sediment control in ditch bottoms, swales, and in waterways. The sediment log may also be used over bare soils and/or temporary and turf reinforcement blankets. A 360° protection around catch basins and drop inlet structures are also specifically referenced for the Curlex® sediment log as are uses in curb and drainage outlets. Finally, the Curlex® sediment log may be used on project ingress and egress termination points or used in place of bails, silt fences, reinforced silt fences and rock checks, or as wattles on steep slopes. Further information on the Curlex® sediment log may be found at www.curlex.com.

The innovative approach to utilizing excelsior wood fibers in a sediment log comprising an elongated tubular member has been found to be both economically viable and environmentally effective for erosion control considerations. Due to the governmental regulations requiring protective measures in the area of erosion control as referenced above, the shipment and ease of delivery of such erosion control units has become important. Due to the size and length of the sediment control logs, such as the above-referenced Curlex® sediment log, shipping and handling is of major concern for both the manufacturer and the ultimate user. When the logs are improperly packaged they can become distorted and the efficiency in use for sediment control reduced. When the logs are shipped in a elongated stack configuration, the amount of space necessary for shipment has been shown to be less than cost effective. It would be an advantage therefore to provide a system for efficient, space-saving packaging and handling sediment logs in a manner facilitating reduced distortion and ease in handling and use.

SUMMARY OF THE INVENTION

The present invention relates to the packaging and handling of sediment logs of elongate sediment control members. More particularly, one aspect of the invention comprises the system of folding and stacking elongate sediment logs in an open compression hopper with each of the logs curled into a generally U shape, J shape, or other pre-selected shape/configuration known to minimize the distortion and/or damage to the log while allowing the configured logs to be stacked one atop the other in a nesting relationship. In this manner, a minimal amount of space is therein required for containing the uncompressed logs. The assemblage is then prepared in the hopper for compression and, once compressed, the assemblage is wrapped with straps, tethers or other members adapted to bind the compressed logs. In this manner, a plurality of elongate sediment control logs are assembled and packaged for shipment in a configuration imparting minimal permanent deformation, for maximum efficiency in use and in a substantially reduced space for maximizing shipping and handling effectiveness.

One aspect the present invention utilizes a commercial bailing hopper for compressing and wrapping the sediment logs prior to shipment. Another aspect, the present invention relates to sediment logs forms of excelsior or wood wool construction disposed in an elongate net structure creating a tubular member of compressible wood wool therein.

In another aspect, the present invention relates to a method of packaging and handling elongate sediment control members of the type forming an elongate body of randomly dispersed, loose-fill fibers having a select loft for retaining sedimentation fluid passing there through when disposed for erosion control, the loose fill fibers being packaged in open mesh material. The method comprises the steps of assembling the sediment control members for packaging, providing a compression hopper adapted for receipt of the assembled sediment control members therein, situating individual sediment control members within the hopper and shaping them into a serpentine assembly for subsequent compression, actuating compression of the hopper and compressing the shaped assembly of sediment control members, binding the compressed sediment control members, removing the bound sediment control members from the hopper, permitting the bound sediment control members to be delivered in the bound condition to a site for decompression and erosion control, and removing the binding from the compressed sediment control members at the sites for erosion control for the positioning and decompression thereof and placement for erosion control.

In another aspect, the above described method includes the steps of providing the loose fill fibers in the form of wood wool and providing the wood wool in the form of excelsior loose fill that is bent, crimped and twisted. The method further includes the step of providing the mesh material in the form of a generally cylindrical net sleeve, which sleeve is formed from synthetic fibers such as polyethylene, polypropylene, and other polyolefins.

In a further aspect, the above described method includes the step of shaping individual sediment control members by bending the sediment control members into a U or J shape within the hopper. A further step includes compressing the shaped elongate sediment control members in the hopper on the order of 60% of the original diameter thereof.

Yet a further aspect of the invention includes a system of packaging elongate sediment control members of the type forming an elongate body of randomly dispersed, loose fill fibers having a select loft for retaining sedimentation in fluid passing there-through when disposed for erosion control, the loose fill fibers being packaged in open mesh material. The system comprises a compression hopper adapted for receipt of the sediment control members therein and the compression thereof and means for situating individual sediment control members within the hopper and shaping them into a serpentine assembly for subsequent compression within the hopper. Also provided are means for binding the compressed sediment control members within the hopper for subsequent handling in the compressed state. The loose fill fibers may comprise wood wool in the form of excelsior loose fill that is bent, crimped and twisted. The compression hopper may be adapted to compress the sediment control members to approximately 60% of the original diameter thereof.

BRIEF DESCRIPTION OF THE DRAWINGS

The preferred embodiment of the invention will now be described, by way of example only, with reference to the accompanying drawings in which.

DETAILED DESCRIPTION OF THE PREFERRED EMBODIMENTS

The present invention will now be described more fully hereinafter with reference to the accompanying drawings in which several preferred embodiments of the invention are shown. This invention may, however, be embodied in many different forms and should not be construed as being limited to the embodiments set forth herein. Rather, the embodiments are provided so that this disclosure is thorough and complete, and fully conveys the scope of the invention to those skilled in the art.

Figure 1:
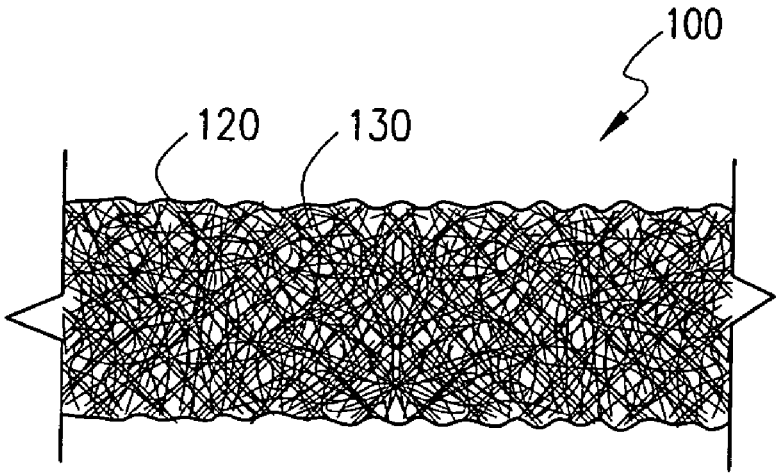
FIG. 1 is a top plan view of a section of an erosion control log constructed in accordance with the aspects of the present invention.
Figure 2:
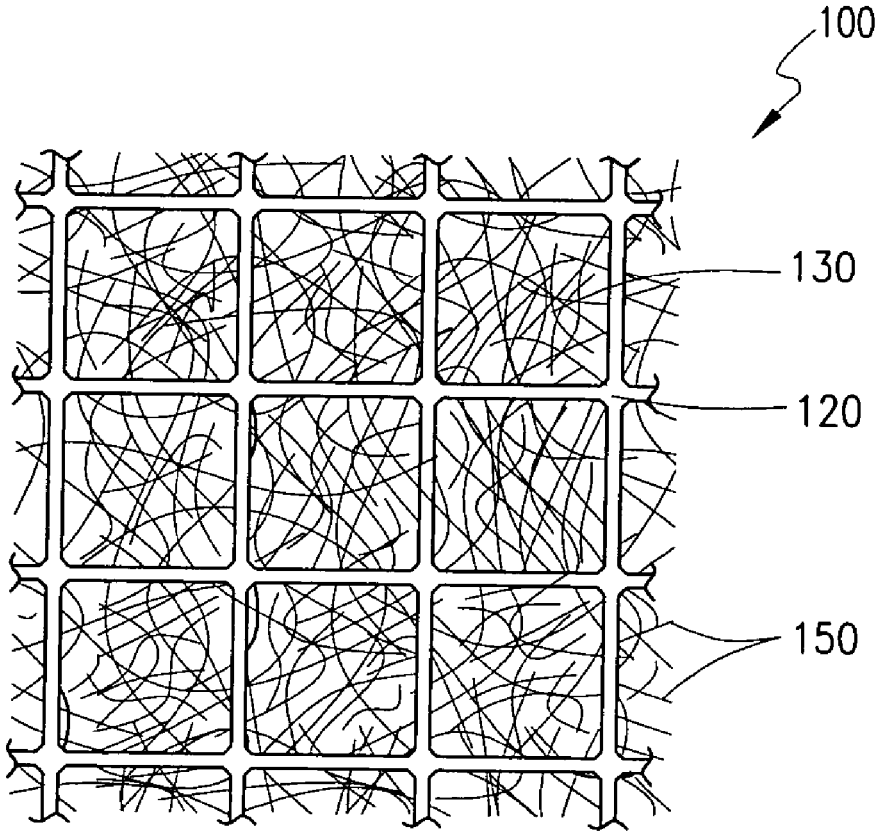
FIG. 2 is an enlarged, fragmentary, cut-away side view of a section of an erosion control log of FIG. 1.
Figure 3:
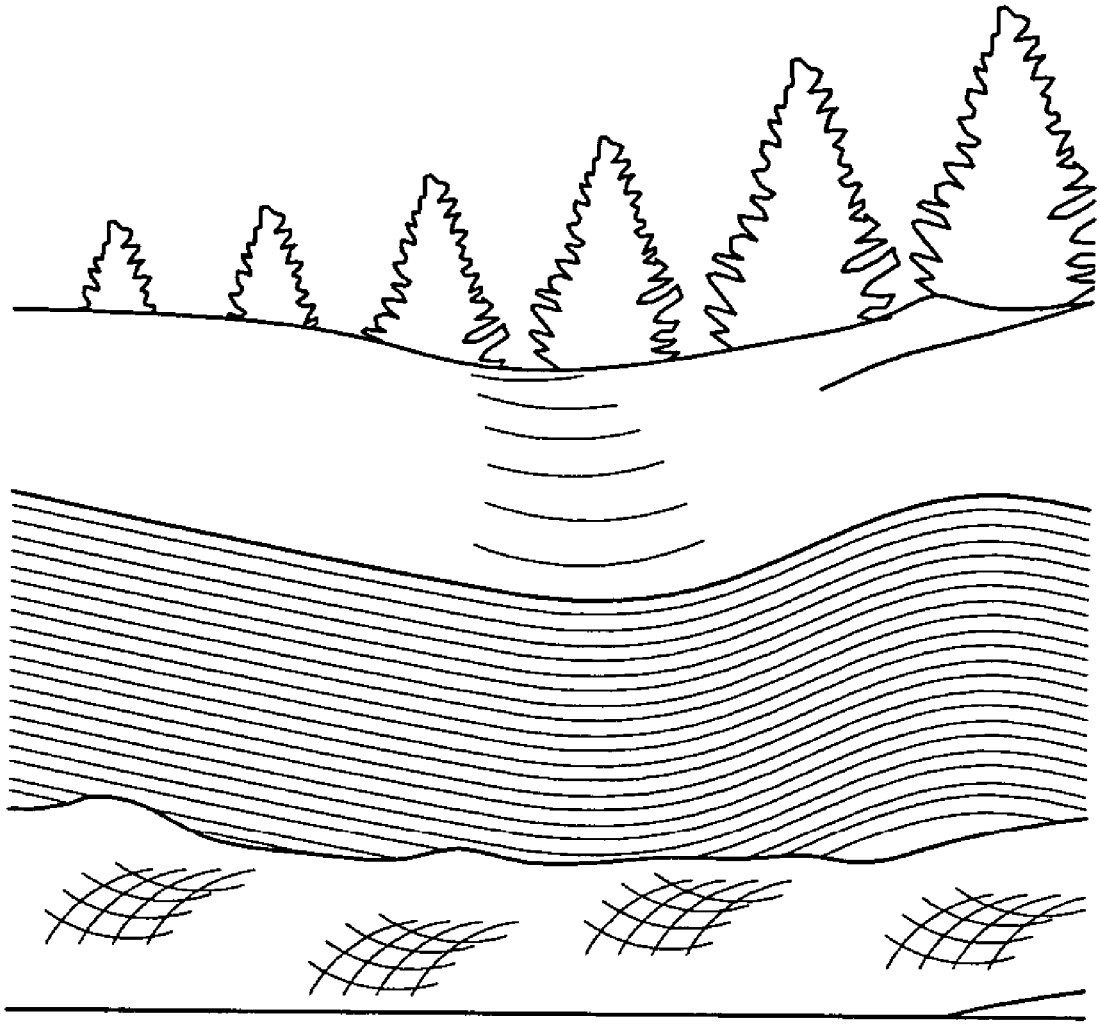
FIG. 3 is a perspective view of an erosion control log of FIG. 1 positioned in an area of water drainage.

Referring now to FIGS. 1-3, a section of an erosion control log 100 of the type used in accordance with the principles of the present invention is set forth and described. Note that each of the drawings have been numbered with like numbers corresponding to like parts. As best seen in FIG. 2, the erosion control log 100 is formed of a sleeve 120, which in the present embodiment is cylindrical, of an open-meshed material of natural or synthetic fibers and filled with a loose fiber filler 130 which is arranged to form a three-dimensional matrix and provides the erosion control log with a required amount of loft or resiliency. Other shapes are contemplated as set forth below.

Referring now to FIGS. 1 and 2, the sleeve 120 is seen to have a open-meshed material or netting with a high percentage of open area. In one embodiment of the present invention, the openings formed by the netting material of sleeve 120 are rectangular in shape with sides ranging from about 0.50 inches to about 1.00 inches in length. The netting itself may be formed of either natural or synthetic materials, and in one preferred embodiment, is of polyethylene (PE), polypropylene (PP), or other suitable polyolefin. It is particularly desirable to make the sleeve 120 or netting of a synthetic material which is both lightweight, strong, and durable enough to resist tearing or rupture of the soil erosion control log 100. The netting material may also include various additives, as known in the art, to improve resistance to ultraviolet (UV) radiation or to impart a particular color. By way of example only, a small amount of carbon black additive, about 0.1% to about 2.5% by weight, may be incorporated into a suitable polymer to impart both a black color and a significant amount of UV resistance into the netting material.

Still referring to FIGS. 1-3, in another embodiment of the present invention, the sleeve 120 may be constructed of select polymer materials, having slightly particular mechanical properties for specific environments. For example, FIG. 3 shows erosion control logs positioned to retain sedimentation in an area of water drainage on a river bank where there may be intense sunlight and prolonged UV radiation. In such a situation, as a way of explanation and not limitation, the sleeve 120 may be formed of 600 denier, high-tensile, polypropylene material having a weight of about 10.0 pounds/1000 square feet and a strand count of about 9.0 and about 13.0 strands/10 inches in the machine and transverse directions, respectively. The netting has rectangular openings with sides of about 0.75 inches to about 1.00 inches in length. The surface of the sleeve 120 would then have a break load of about 57.0 pounds/3 inches in the machine direction and about 73.0 pounds/3 inches in the transverse direction.

The filler material 130 of the erosion control log 100 described above comprises, in one embodiment of the system of the present invention, excelsior, also known as wood wool. The excelsior is typically found in a complex arrangement of bent, twisted and crimped fibers creating a three-dimensional matrix having a desired amount of loft and resiliency. Although the excelsior fibers 150 may be arranged in various ways, due to their twisted and bent configuration, a randomly dispersed loose excelsior fiber will generally produce a log with sufficient loft. It is this loft that comprises one aspect of the present invention, as a method of and system for sedimentation retaining barrier packing is provided. As shown herein, the logs 100 are handled in a way so as to minimize the distortion and/or damage to the log while allowing the logs to be stacked one on top of the other in a nesting relationship for shipment.

Figure 4:
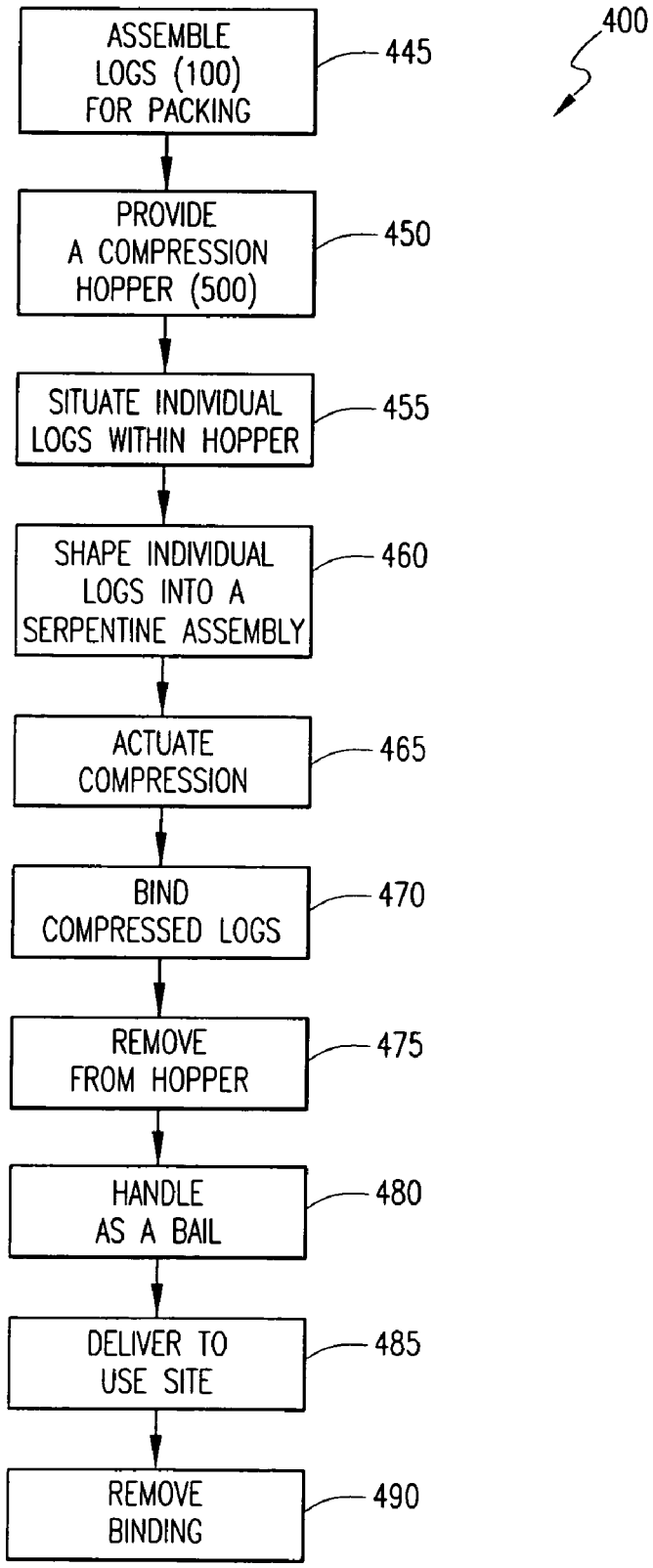
FIG. 4 is a block diagram of steps which are carried out for packing and handling an erosion control log in accordance with the present invention.
Figure 5:
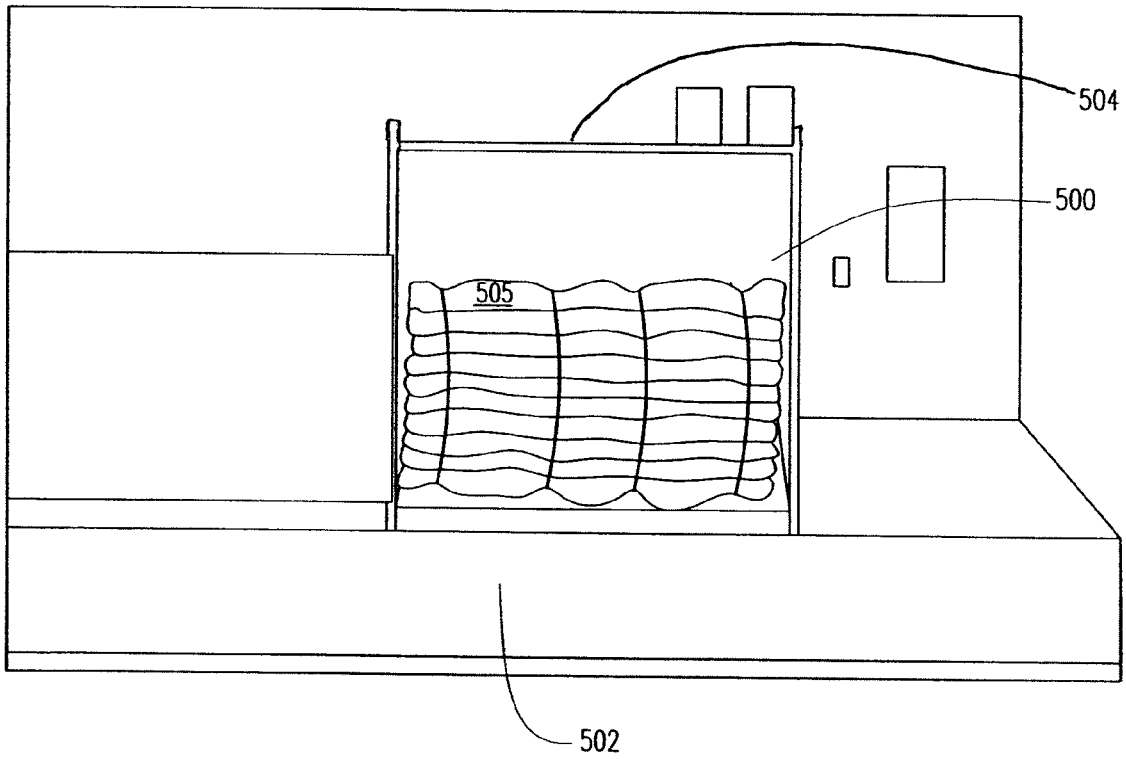
FIG. 5 is a front elevational view of one step of packing an erosion control log of FIG. 1 in accordance with FIG. 4.

Referring now to FIGS. 4 and 5, a block diagram illustrates, by way of example only, the various steps of one embodiment of a packing process 400 which may be followed to minimize permanent deformation of the logs 100 while preparing them for shipment in accordance with the present invention. In one embodiment, a compression hopper 500 is provided with an open frontal region 502 allowing the logs 100 to be inserted therein. A compression or bailing plate 504 is positioned thereabove and adapted for compressing the properly aligned logs 100 for subsequent securement.

Figure 5A:
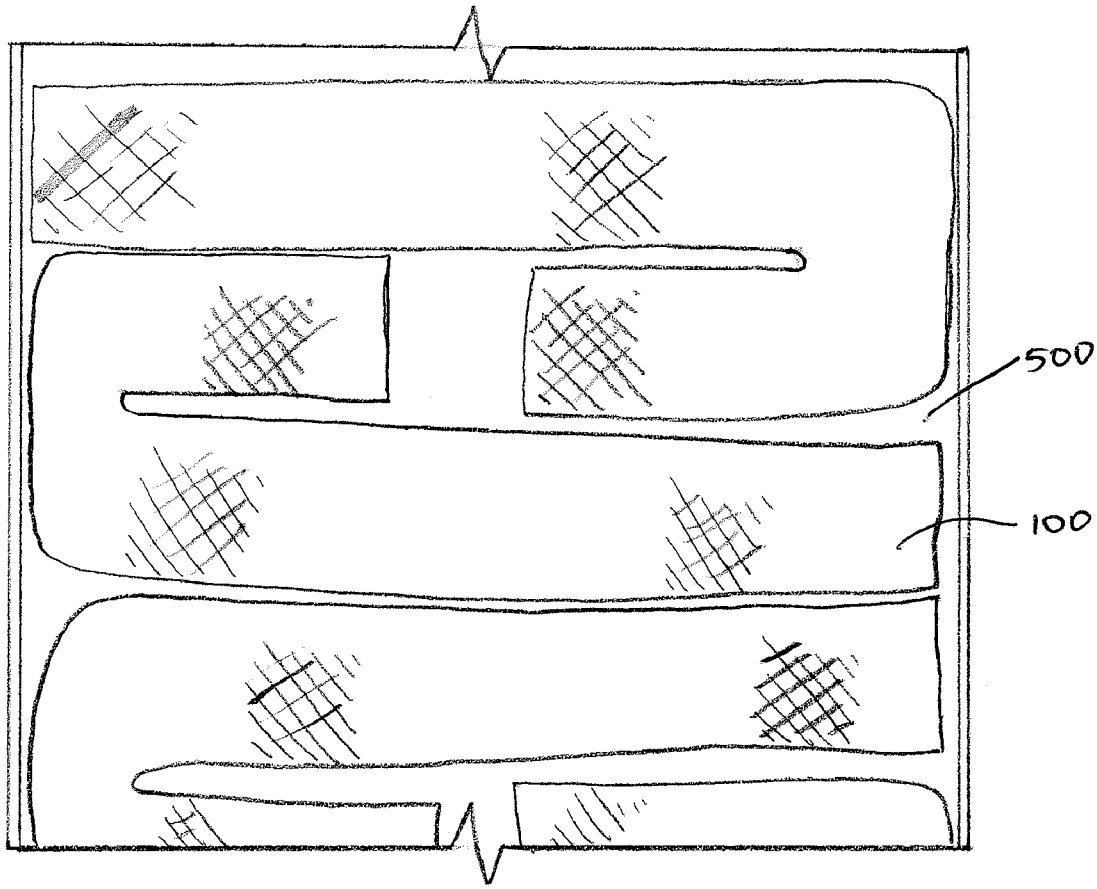
FIG. 5A is an enlarged diagrammatic schematic showing a section of a hopper containing erosion control logs bent into U or J shaped configurations and aligned in a serpentine fashion.

Referring specifically now to FIG. 4, the packing process 400 comprises the following steps: assembling logs 100 for purposes of packing the shipment in step 445; providing a compression hopper 500 in step 450; situating individual logs 100 within the hopper 500 in step 455; bending and shaping the logs 100 to conform with pre-aligned bent portions within the hopper 500 (for example bending the logs into generally U shaped and or J shaped configurations) to align the logs 100 one against the other in a serpentine assembled fashion in step 460 (shown in detail in FIG. 5A); actuating the compression plate 504 (FIG. 5) in step 465 to compress the aligned logs 100 into a desired level of compression (for example, compressed to around 60% of the original diameter) suitable for shipping and handling; applying securing bands or tethers about the compressed logs 100 in step 470 to form a packaged assembly ready for handling. Assembling up to around four layers for compression may be preferable in some applications, but any number of layers can be compressed (for example, ten layers are shown in FIG. 5).

Referring still to FIGS. 4 and 5, the compressed logs 100 may be bound by metal bands, tethers formed of synthetic material, and/or any other binding materials, such as rope, wire or the like providing appropriate strength without damaging the compressed logs bound therewith. It may be seen that when using a very narrow or sharp element, such as wire, it may be necessary to incorporate a flexible member (such as fabric) between the binding member and the log 100 to prevent tearing and permanent damage to the log. The compressed and bound logs may then be removed in the form of a bail 505 from the hopper 500 in step 475. The bail 505 thus provides the logs in condition for appropriate handling in step 480. This handling of multiple logs as bail 505 provides both reduced shipping space and ease in handling an otherwise cumbersome item that may be prone to bend, twist and/or move in a fashion hindering the ease and efficiency in handling. With the present invention, the handling of the sedimentation barrier logs 100 as bail 505 maximizes handling efficiency while reducing damage to the individual logs until they can be delivered to the use site as set forth in step 485. Once at the use site, the bails 505 again can be carried to specific use site areas where the binding is cut and/or otherwise removed in step 490 to allow the logs to expand and decompress. In this manner, the logs 100 are available for the use as shown in FIG. 3.

Referring now to FIG. 5, there is shown a perspective view of the hopper 500 with the logs 100 secured therein by tethers after the compression operation described above. It may be seen that the logs are assembled into above described bail 505 with each manifesting a minimum number of folds and thus minimizing the potential for permanent deformation prior to delivery and use.

Figure 6:
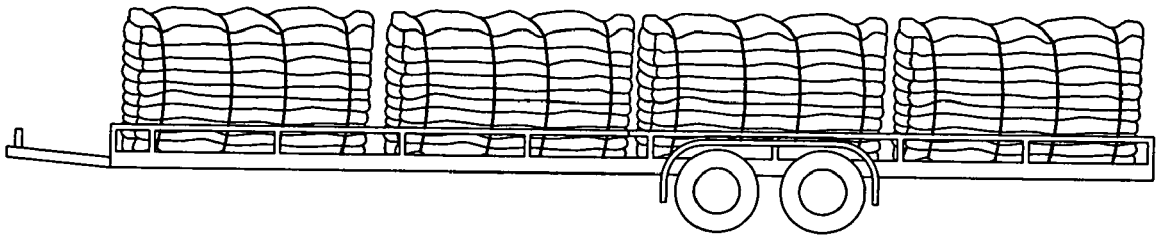
FIG. 6 is a front elevational view of the delivery for handling of the erosion control log of FIG. 1.

FIG. 6 illustrates the compressed and bound erosion control logs being delivered by a trailer for handling. It has been found that sediment control members formed of wood wool as described herein and compressed on the order of 60% of their original diameter will retain decompressibility better than those compressed substantially more, however other levels of compression have been found to be beneficial depending on specific shipping and utilization requirements.

It is thus believed that the operation and construction of the present invention will be apparent from the foregoing description of the preferred embodiments. While the erosion control log, configurations and designs as shown are described as being preferred, it will be obvious a person of ordinary skill in the art that various changes and modifications may be made therein without departing from the spirit and scope of the invention, as defined in the following claims. Therefore, the spirit and the scope of the appended claims should not be limited to the description of the preferred embodiments contained herein.

The invention claimed is:

1. A method of packaging and handling elongate sediment control members of the type forming an elongate body of randomly dispersed, loose-fill fibers having a select loft for retaining sedimentation fluid passing there through when disposed for erosion control, the loose fill fibers being packaged in open mesh material to form each of the elongated sediment control members, the method comprising the steps of:

assembling the sediment control members for packaging; providing a compression hopper adapted for receipt of the assembled sediment control members therein;

situating each of the sediment control members within the hopper and shaping each of the sediment control members into a serpentine assembly for subsequent compression;

actuating a compressing plate of the hopper and compressing the shaped assembly of sediment control members;

binding the compressed sediment control members within the hopper;

removing the bound sediment control members from the hopper;

permitting the bound sediment control members to be delivered in the bound condition to a site for decompression and erosion control; and removing the binding from the compressed sediment control members at the sites for erosion control for the positioning and decompression thereof and placement for erosion control.

2. The method as set forth in claim 1 including the steps of providing the loose fill fibers in the form of wood wool.

3. The method as set forth in claim 2 and further including the step providing the wood wool in the form of excelsior loose fill that is bent, crimped and twisted.

4. The method as set forth in claim 1 and further including the step of providing the mesh material in the form of a generally cylindrical net sleeve.

5. The method as set forth in claim 4 and including the step of providing the net sleeve with generally rectangular net openings.

6. The method as set forth in claim 4 and further including the step of providing the net sleeve from synthetic fibers.

7. The method as set forth in claim 6, wherein the synthetic fibers are formed from one of polyethylene, polypropylene, and other polyolefin.

8. The method as set forth in claim 1 wherein the step of shaping each of the sediment control members includes the step of bending the sediment control members into a U shape within the hopper.

9. The method as set forth in claim 1 wherein the step of shaping each of the sediment control members includes the step of bending the sediment control members into a generally J shaped configuration.

10. The method as set forth in claim 1 wherein the step of binding the compressed sediment control members includes the steps of providing at least one band having opposite ends and securing the opposite ends around the shaped and compressed sediment control members after compression.

11. The method as set forth in claim 10 wherein the at least one band is made of metal.

12. The method as set forth in claim 10 wherein the at least one band is made of synthetic material.

13. The method as set forth in claim 1 and further including the step of compressing the elongate sediment control members in the hopper to approximately 60% of the original diameter thereof.

14. The method as set forth in claim 13 and further including the step of situating four layers of sediment control members one atop the other in the serpentine assembly to form an overall assembly and compressing the overall assembly a magnitude on the order of approximately 60% of its original height prior to binding prior to the binding thereof.

15. A method of packaging elongate sediment control members of the type forming an elongate body of randomly dispersed, loose fill fibers having a select loft for retaining sedimentation in fluid passing there-through when disposed for erosion control, the loose fill fibers being packaged in open mesh material to form each of the elongated sediment control members, the method comprising the steps of:

providing a compression hopper adapted for receipt of the sediment control members therein and the compression thereof;

situating each of the sediment control members within the hopper;

shaping individual ones of the sediment control members into a serpentine assembly for subsequent compression within the hopper;

actuating a compressing plate of the hopper and compressing the shaped assembly of the sediment control members; and binding the compressed sediment control members within the hopper for subsequent handling in the compressed state.

16. The method as set forth in claim 15 including the steps of providing the loose fill fibers in the form of wood wool.

17. The method as set forth in claim 16 and further including the step providing the wood wool in the form of excelsior loose fill that is bent, crimped and twisted.

18. The method as set forth in claim 15 and further including the step of providing the meshed material in the form of a generally cylindrical net sleeve.

19. The method as set forth in claim 18 and including the step of providing the net sleeve with generally rectangular net openings.

20. The method as set forth in claim 18 wherein the net sleeve is made of synthetic fibers.

21. The method as set forth in claim 20 wherein the synthetic fibers are formed from one of polyethylene, polypropylene, and other polyolefin.

22. The method as set forth in claim 15 wherein the step of shaping individual sediment control members includes the step of bending the sediment control members into a U shape within the hopper.

23. The method as set forth in claim 15 wherein the step of shaping individual sediment control members includes the step of bending the sediment control members into a generally J shaped configuration.

24. The method as set forth in claim 15 wherein the step of binding the compressed sediment control members includes the steps of providing at least one band having opposite ends and securing the opposite ends around the shaped and compressed sediment control members after compression.

25. The method as set forth in claim 24 wherein the at least one band is made of metal.

26. The method as set forth in claim 24 wherein the at least one band is made of synthetic material.

27. The method as set forth in claim 15 and further including the step of compressing the elongate sediment control members in the hopper to approximately 60% of the original diameter thereof.

28. The method as set forth in claim 27 and further including the step of situating four layers of the sediment control members one atop the other in the serpentine assembly to form an overall assembly and compressing the overall assembly a magnitude on the order of approximately 60% of its original height prior to binding prior to the binding thereof.

* * * * *

UNITED STATES PATENT AND TRADEMARK OFFICE

CERTIFICATE OF CORRECTION

PATENT NO. : 7,415,923 B2
APPLICATION NO. : 11/252647
DATED : August 26, 2008
INVENTOR(S) : Kenneth Starrett et al.

It is certified that error appears in the above-identified patent and that said Letters Patent is hereby corrected as shown below:

In Column 7, Claim 14
Line 61

Insert the word -- the -- after "of" and before "sediment"

Signed and Sealed this

Thirtieth Day of December, 2008

JON W. DUDAS
*Director of the United States Patent and Trademark Office*